US005935349A

United States Patent [19]

Sauthoff et al.

[11] Patent Number: 5,935,349

[45] Date of Patent: Aug. 10, 1999

[54] INTERMETALLIC NICKEL-ALUMINUM BASE ALLOY AND MATERIAL FORMED OF THE ALLOY

[75] Inventors: Gerhard Sauthoff, Ratingen; Benedikt Zeumer, Düsseldorf, both of Germany

[73] Assignees: Siemens Aktiengesellschaft, Munich; H. C. Starck GmbH & Co. KG, Laufenburg/Baden, both of Germany

[21] Appl. No.: 08/757,554

[22] Filed: Nov. 21, 1996

Related U.S. Application Data

[63] Continuation of application No. PCT/EP95/01921, May 19, 1995.

[30] Foreign Application Priority Data

May 21, 1994 [DE] Germany ..... P 44 17 936

[51] Int. Cl.[6] ..... C22C 19/05

[52] U.S. Cl. ..... 148/410; 148/428; 420/445; 420/450

[58] Field of Search ..... 75/246; 148/404, 148/409, 410, 428, 429; 420/445, 450

[56] References Cited

U.S. PATENT DOCUMENTS

| | | | |
|---|---|---|---|
| 5,116,691 | 5/1992 | Darolia et al. | 420/445 |
| 5,516,380 | 5/1996 | Darolia et al. | 148/404 |

FOREIGN PATENT DOCUMENTS

| | | |
|---|---|---|
| 0 502 654 A1 | 9/1992 | European Pat. Off. . |
| 1 812 144 | 8/1969 | Germany . |

OTHER PUBLICATIONS

"Single–Cristalline–Dentritic Solidification of Geometries similar to Turbine Blades by means of Seed Techniques" (Paul), Series 5, No. 264, VDI Edition, pp. I–XXI and 1–138; 27/92.

"Fractional Viscosity of Intermettalic Alloys" (Reuss), pp. 1–100. May 1991.

"NiA1 Alloys for High–Temperature Structural Applications", The Journal of Metals, Mar. 1991, pp. 44 et seq.

"Lifetime and Fracture of Directionally Crystallized Eutectic Composites", Phys. Met. Metall, vol. 70, No. 2, pp. 194–196, 1990.

CA 113:126250. 1990.

"Phase Composition and Structure of NiAl–based alloys of Ni–Al–Co–M Systems, where M is Ti, Zr, Hf, V, Nb, Ta, Cr, Mo" in *Mettaly* (3), pp. 85–94 by Povarova, K.B. et al., Mar. 1996.

ASM Handbook, vol. 2, p. 1096, 1990.

D.R. Johnson et al Intermetallics pp. 493–503, 1995.

*Primary Examiner*—John Sheehan
*Attorney, Agent, or Firm*—Herbert L. Lerner; Laurence A. Greenberg

[57] ABSTRACT

An intermetallic nickel-aluminum base alloy has a microstructure which predominantly includes the binary phase NiAl and further contains the elements chromium and tantalum. The content of the elements chromium and tantalum is in total at most 12 atom %. Preferred contents ranges are 0.3 to 3.8 atom % tantalum and 1.0 to 9.0 atom % chromium. The intermetallic nickel-aluminum base alloy is distinguished in particular by high oxidation resistance at high temperatures, such as for example 1350° C. It is therefore suitable for producing components which are exposed to a high long term temperature stress such as, for example, gas turbine blades. Depending on requirements, additional layers protecting against oxidation can be dispensed with due to the high oxidation resistance.

20 Claims, No Drawings

INTERMETALLIC NICKEL-ALUMINUM BASE ALLOY AND MATERIAL FORMED OF THE ALLOY

CROSS-REFERENCE TO RELATED APPLICATION

This application is a Continuation of International Application Ser. No. PCT/EP95/01921, filed May 19, 1995.

BACKGROUND OF THE INVENTION

FIELD OF THE INVENTION

The invention relates to an intermetallic nickel-aluminum base alloy having a binary phase NiAl. The invention also relates to a material formed of the intermetallic nickel-aluminum base alloy for producing a gas turbine component or other articles.

Such an intermetallic nickel-aluminum base alloy is known from an article entitled "NiAl Alloys for High-Temperature Structural Applications" in the Journal of Metals, March 1991, pages 44 et seq.

A process is described in German Published, Prosecuted Patent Application 1 812 144 for producing a high-strength nickel-aluminum material having good oxidation resistance. In the process, nickel powder is mixed with aluminum powder, then pressed and then cold-formed so that a self-supporting and coherent shaped body is formed having a fibrous or laminar structure. The nickel content is at least 80% and that of the aluminum is at most 20%. The coherent shaped body is then successively hot-formed at respective elevated temperatures. Apart from a solid solution of the aluminum in the nickel, principally the compound NiAl is additionally formed in that case. That solid solution and the compound NiAl could be detected by X-ray analysis. The extent to which other compounds between nickel and aluminum can be achieved by the process cannot be learned from that published application.

SUMMARY OF THE INVENTION

It is accordingly an object of the invention to provide an intermetallic nickel-aluminum base alloy and a material formed of the alloy, which overcome the hereinaforementioned disadvantages of the heretofore-known materials of this general type and which have improved thermal and mechanical properties including, in particular, thermal strength, oxidation resistance and thermal shock resistance.

With the foregoing and other objects in view there is provided, in accordance with the invention, an intermetallic nickel-aluminum base alloy, comprising predominantly a binary phase NiAl, and chromium and tantalum, the chromium and tantalum having a total content of up to 12 atom %, and at least one element selected from the group consisting of iron, molybdenum, tungsten, niobium and hafnium each having a respective content of up to 1 atom %, and having a total content of the group of at most 3 atom %.

In accordance with another feature of the invention, the content of the binary phase NiAl is preferably between 70 and 95 atom %, in particular between 85 and 90 atom %.

In accordance with a further feature of the invention, the preferred contents ranges for tantalum and chromium are from 0.3 to 3.8 atom % and 1.0 to 9.0 atom %, respectively.

In accordance with an added feature of the invention, within these ranges, preferably 0.3 to 0.9 atom % tantalum and 1.0 to 3 atom % chromium or 1.7 to 3.0 atom % tantalum and 6.0 to 9.0 atom % chromium are used.

In accordance with an additional feature of the invention, the ratio of tantalum to chromium in this case is preferably 1:3 or less. With such a ratio, the concentration of substitution elements in the NiAl reaches a maximum. Due to the addition of tantalum and chromium, in the intermetallic nickel-aluminum base alloy on the grain boundaries of the binary phase NiAl, precipitation in a coarse multinary Laves phase occurs, in which the elements Ni, Al, Cr and Ta can have participated.

In accordance with yet another feature of the invention, in addition, within the NiAl grains, there are precipitations of finely divided Laves phase and α-chromium. It is preferred that the microstructure includes 5 to 11% by volume of Laves phase, 3 to 10% by volume of precipitations in NiAl and NiAl as the remainder.

In accordance with yet a further feature of the invention, there is provided a microstructure that has proved to be particularly advantageous and which includes about 11% by volume of Laves phase on the grain boundaries and about 10% by volume of precipitations in the NiAl and NiAl as the remainder.

In accordance with yet an added feature of the invention, a further improvement of certain properties is provided if the alloy containing at least one element selected from the group consisting of iron, molybdenum, tungsten and hafnium in an amount of up to 1 atom % in each case, but in total at no more than 3 atom %, additionally contains trace elements such as oxygen, nitrogen and sulfur as well as process-specific impurities.

The addition of tantalum and chromium in the respective contents ranges specified above forms the already mentioned coarse or finely divided multinary laves phases and α-chromium. These precipitations are generally at the interstices of various NiAl grains. Amounts of the alloy elements tantalum or chromium which are higher than those specified can lead to the amount of the precipitations increasing in an undesirable manner. In the case of an excessive increase in the volume fractions of Laves phase, a cellular structure is formed in which the Laves phase adapts the function of the matrix. An excessive proportion of Laves phase in the microstucture makes the intermetallic alloy brittle and more difficult to process.

An increase in strength under short-term load can be achieved by addition of one or more elements selected from the group consisting of iron, molybdenum, tungsten, niobium and hafnium, each at up to 1 atom %, but in total not more than 3 atom %. However, the creep strength is decreased. The addition of hafnium effects an improved adhesion of the oxide layer after first corrosion.

With the objects of the invention in view there is also provided a component of a gas turbine, in particular a high-temperature stress component such as a gas turbine blade, produced by using the NiAl base alloy. A gas turbine component, in particular a turbine blade, produced from the base alloy, because of the high oxidation resistance, is particularly suitable for long-term use at high temperatures, for example above 1100° C., in particular at 1350° C. Depending on requirements, in such a component an additional coating with protective layers can be omitted, in contrast to superalloys. A turbine blade produced in this manner including a uniform alloy without layers to be additionally applied thereon is considerably simpler to produce and in comparison to the turbine blades including a plurality of layers, is freed form the problem of bonding between the individual layers.

With the objects of the invention in view there is additionally provided a material using the intermetallic nickel-aluminum base alloy for producing articles which must possess high tensile strength, good high-temperature strength, good toughness, good oxidation resistance and good thermal shock resistance. The tensile strength in this case for a 0.2% proof stress at room temperature is above 600 Mpa. The thermal strength at the 0.2% proof stress is above 200 MPa at 800° C. and above 90 MPa at 1000° C. The toughness is at least 7 MPa/m and the oxidation resistance is on the order of $5 \cdot 10^{-14}$ $g^2$ $cm^{-4}$ s.

Other features which are considered as characteristic for the invention are set forth in the appended claims.

Although the invention is illustrated and described herein as embodied in an intermetallic nickel-aluminum base alloy and a material formed of the alloy, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the following examples.

DESCRIPTION OF THE PREFERRED EMBODIMENTS

Referring now to the examples of the invention in detail, it is seen that the composition (in atom %) of alloys studied is given in the following Table 1.

| | Ni | Al | Ta | Cr | Others |
|---|---|---|---|---|---|
| SSM 364 | 45.00 | 45.00 | 2.50 | 7.5 | |
| VA 2823 | 44.50 | 44.50 | 2.50 | 8.00 | 0.39 Fe, 0.105 C |
| USM 2823 | 44.40 | 43.90 | 2.90 | 8.50 | 0.14 Fe, 0.02 C |
| USM 2922 | 45.00 | 45.00 | 2.00 | 8.00 | |
| PM 75/76 | 44.10 | 44.10 | 2.40 | 7.70 | 0.09 Fe, 0.06 C, 0.09 33 ppm N, 14 ppm S |
| VA 892/SP75 | 44.50 | 45.20 | 2.53 | 7.60 | 90 ppm Hf, 0.04 C, 20 61 ppm 0 |

The micro structure development, i.e. the grain size, the precipitation distribution and the precipitation size varies greatly with the production process. Thermodynamic treatments, extrusion (SP) or using powder metallurgy production (PM) homogenizes the distribution of the Laves phase particles.

The mechanical properties of the alloys are also strongly dependent on the production process that is chosen. The following production routes are followed for these alloys:

directed solidification as a potential method of producing low-defect microstructures by casting technology. The process parameters correspond to those of superalloys (see the publication by U. Paul, in VDI-Fortschrittsbericht [VDI-Progress Report] No. 264, VDI-Publishers);

powder metallurgy: by inert gas injection and subsequent hot isostatic pressing at 1250° C.;

extrusion pressing for microstructure homogenization and setting defined grain diameter sizes 1250° C.;

hot pressing under a multiaxial stress state at 1100° C.

Samples subjected to directed solidification have a clearly high tensile strength while, for example, extruded material has a decreased or very low tensile strength. In the following Table 2, the 0.2% proof stress in the compressive test is shown for the various alloys and for NiAl.

TABLE 2

| Temperature in ° C. Alloy No.: | 23 | 200 | 400 | 600 | 800 | 900 | 1000 | 1100 | 1200 |
|---|---|---|---|---|---|---|---|---|---|
| SSm 364 | 650 | | 520 | 451 | 201 | 146 | 94 | 60 | 46 |
| VA 2823 | 640 | | 524 | 414 | 264 | | 137 | 83 | |
| USM 2823 | 1501 | | 1494 | 584 | 404 | | 186 | 125 | 88 |
| PM 75 | 814 | | 593 | 456 | 284 | | 126 | 65 | |
| PM 7G | 869 | | 562 | 466 | 275 | | 113 | 51 | |
| VA 892 | | | | | | | | 133 | |
| SP 75 | 730 | | 581 | 344 | 294 | | 113 | 69 | |

The creep resistance (in Mpa) of the alloys studied in the compression test (secondary stationary creep strength as a function of the strain rate [1/s] at 1000° C. and 1100° C.) is shown in Table 3.

TABLE 3

| Strain Rate in 1/s Alloy No.: | 1.00E−09 at 1000° C. | 1.00E−07 at 1000° C. | 1.00E−06 at 1000° C. | 1.00E−08 at 1100° C. | 1.00−07 at 1100° C. | 1.00−06 at 1100° C. |
|---|---|---|---|---|---|---|
| SSm 364 | 19.90 | 36.10 | 55.50 | 14.60 | 20.00 | 34.60 |
| VA/SM | | | | 16.50 | 23.20 | 33.40 |
| USM 2823 (cast) | | 79.00 | 98.00 | 28.50 | 32.80 | 39.00 |
| PM 75 | 13.90 | 22.90 | 36.80 | | | 17.50 |
| PM 76 | 11.20 | 19.90 | 33.80 | | | 11.00 |
| SP 75 | 10.00 | 18.00 | 33.90 | | | 11.10 |

The creep strengths of this alloy are higher than the creep strengths of comparable intermetallic phases, for example higher than the creep strength of binary NiAl or that of NiAlCr alloys.

Table 4*a* compares the 0.2% proof stress (in MPa) in the compression test of a conventional superalloy, a binary NiAl alloy and a NiAl-Ta-Cr-alloy.

TABLE 4a

| Temperature: | Superalloy | $Ni_{50}Al_{50}$ | NiAl—Ta—Cr Cast/PM75 |
|---|---|---|---|
| 900° C. | 424 | 47 | 345/205 |
| 1000° C. | 135 | 26 | 186/126 |
| 1100° C. | 28 | 18 | 125/65 |

Based on the 0.2% proof stress, the superiority of the novel alloy is evident at temperatures above 1000° C.

A comparison of the stationary creep resistance at $\epsilon=10^7$ l/s (in Mpa) in the compression test of a superalloy, a binary NiAl alloy and the developed NiAl-Ta-Cr alloy is given by the following Table 4*b*:

TABLE 4b

| Temperature: | $Ni_{50}Al_{50}$ | NiAl—Ta—Cr 2823/2922 | NiAl—Ta—Cr PM75/SP75 |
|---|---|---|---|
| 1000° C. | 13 | 79/89 | 23/19 |
| 1100° C. | n.d. | 33/33 | 10/6 |
| 1200° C. | n.d. | /21 | |

The abbreviation n.d. herein denotes that the corresponding value was not determined.

In comparison with conventional superalloys, the NiAl-Ta-Cr alloy has the advantage of having sufficient tensile strength even above 1050° C. to 1150° C. There is no sudden drop in tensile strength in this alloy due to dissolution of the solidified phase.

Table 5 shows a comparison of $K_{IC}$ values, that are known from industrial figures, of various ceramics and of the NiAl-Ta-Cr alloy produced by the powder metallurgy process.

TABLE 5

| | NiAl cast | NiAl—Ta—Cr cast | NiAl—Ta—Cr PM | NiAl—Ta—Cr Sp | SiC |
|---|---|---|---|---|---|
| $K_{IC}$/ MPa m | 4–5* | 4.5 | 8 | 8–11 | 4.6 |

*Reuβ, Dissertation, RWTH, Aachen, Germany.

The toughness of the intermetallic NiAl base alloy is markedly better than the data measured for binary NiAl and SiC.

The alloy has a good oxidation resistance of the order of $5\cdot10^{-14}$ $g^2$ $cm^{-4}$ s, which is thus equal to or better than the oxidation resistance of binary NiAl. In contrast to the superalloy, no protective layers, for example of ceramic material, are thus necessary at high temperatures. This avoids the problem of bonding between ceramic and metallic components.

A sufficient thermal shock strength is produced. At 1350° C., 500 temperature cycles are achieved by the alloy without damage to the material.

We claim:

1. An intermetallic nickel-aluminum base alloy consisting essentially of:

a) binary phase NiAl b) more than 0.3 atom % tantalum, more than 1.0 atom % chromium, wherein tantalum plus chromium total not more than 12 atom %; and c) 0–1 atom % of at least one element selected from a group consisting of iron, molybdenum, tungsten, wherein said at least one element totals not more than 3 atom %.

2. The intermetallic nickel-aluminum base alloy according to claim 1, with 0.3 to 3.8 atom % tantalum and 1.0 to 9.0 atom % chromium.

3. An intermetallic nickel-aluminum base alloy consisting essentially of a binary phase NiAl, more than 0.3 atom % tantalum, more than 1.0 atom % chromium, wherein tantalum plus chromium total not more than 12 atom %.

4. The intermetallic nickel-aluminum base alloy according to claim 3, with 0.3 to 3.8 atom % tantalum and 1.0 to 9.0 atom % chromium.

5. The alloy according to claim 1, wherein the binary phase NiAl makes up 70 atom % to 95 atom % of a microstructure.

6. The alloy according to claim 1, wherein the binary phase NiAl makes up 85 atom % to 90 atom % of a microstructure.

7. The alloy according to claim 1, including 0.3 atom % to 0.9 atoms tantalum and 1.0 atom % to 3.0 atom % chromium.

8. The alloy according to claim 1, including 1.7 at % to 3.0 atom % tantalum and 6.0 at % to 9.0 at % chromium.

9. The alloy according to claim 1, wherein said tantalum and chromium are in a ratio of at most 1:3.

10. The alloy according to claim 1, wherein at least some NiAl grain boundaries precipitations of coarse Laves phase are present, and within at least some nickel-aluminum grains, precipitations of finely divided Laves phase and α-chromium are present.

11. The alloy according to claim 10, including a microstructure containing from 5 to 11% by volume precipitations of coarse Laves phase, 3 to 10% by volume precipitations of finely divided Laves phase and α-chromium in the NiAl.

12. The alloy according to claim 11, wherein the microstructure has about 11% by volume of Laves phase on the grain boundaries and about 10% by volume of precipitations in the binary NiAl.

13. The alloy according to claim 3, wherein the binary phase NiAl makes up 70 atom to 95 atom % of a microstructure.

14. The alloy according to claim 3, wherein the binary phase NiAl makes up 85 atom % to 90 atom % of a microstructure.

15. The alloy according to claim 3, including 0.3 atom % to 0.9 atom tantalum and 1.0 atom % to 3.0 atoms chromium.

16. The alloy according to claim 3, including 1.7 at % to 3.0 atom % tantalum and 6.0 at % to 9.0 at % chromium.

17. The alloy according to claim 3, wherein said tantalum and chromium are in a ratio of at most 1:3.

18. The alloy according to claim 3, wherein at least some NiAl grain boundaries precipitations of coarse Laves phase are present, and within at least some nickel-aluminum grains, precipitations of finely divided Laves phase and α-chromium are present.

19. The alloy according to claim 18, including a microstructure containing from 5 to 11% by volume precipitations of coarse Laves phase, 3 to 10% by volume precipitations of finely divided Laves phase and α-chromium in the NiAl.

20. The alloy according to claim 19, wherein the microstructure has about 11% by volume of Laves phase on the grain boundaries and about 10% by volume of precipitations in the binary NiAl.

* * * * *